US009200526B2

(12) United States Patent
Ito et al.

(10) Patent No.: US 9,200,526 B2
(45) Date of Patent: Dec. 1, 2015

(54) TRANSITION PIECE BETWEEN COMBUSTOR LINER AND GAS TURBINE

(75) Inventors: Shoko Ito, Sagamihara (JP); Daizo Saito, Yokohama (JP); Yoshiaki Sakai, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 987 days.

(21) Appl. No.: 13/332,106

(22) Filed: Dec. 20, 2011

(65) Prior Publication Data

US 2012/0159954 A1 Jun. 28, 2012

(30) Foreign Application Priority Data

Dec. 21, 2010 (JP) ..... P2010-284079

(51) Int. Cl.
*F02C 3/02* (2006.01)
*F23R 3/54* (2006.01)
*F01D 9/02* (2006.01)

(52) U.S. Cl.
CPC ..... *F01D 9/023* (2013.01)

(58) Field of Classification Search
CPC ..... F01D 9/023; F23R 3/002; F23R 3/02; F23R 3/54
USPC ..... 60/752–760
See application file for complete search history.

(56) References Cited

U.S. PATENT DOCUMENTS 2,594,808 A * 4/1952 Rubbra ..... 60/39.37
2,608,057 A * 8/1952 Boyd et al. ..... 60/39.37
3,844,116 A * 10/1974 Matto ..... 60/800
4,297,843 A 11/1981 Sato et al.
4,573,315 A * 3/1986 Stroem ..... 60/39.37
4,719,748 A 1/1988 Davis, Jr. et al.
4,872,312 A 10/1989 Iizuka et al.
4,896,499 A * 1/1990 Rice ..... 60/792
4,903,477 A 2/1990 Butt
5,237,813 A * 8/1993 Harris et al. ..... 60/804

(Continued)

FOREIGN PATENT DOCUMENTS

CA 1 262 868 11/1989
CN 86 1 04500 A 2/1987

(Continued)

OTHER PUBLICATIONS

Search and Examination Report issued by the Intellectual Property Office of Singapore on Dec. 18, 2012, for Singapore Patent Application No. 201109376-2.

*Primary Examiner* — Phutthiwat Wongwian
*Assistant Examiner* — Carlos A Rivera
(74) *Attorney, Agent, or Firm* — Finnegan, Henderson, Farabow, Garrett & Dunner, L.L.P.

(57) ABSTRACT

A transition piece 10 in an embodiment is provided with an inner duct 20 through which a combustion gas is led to a turbine part 130 and an outer duct 30 that is provided so as to cover an outer periphery of the inner duct 20 and has a plurality of ejection holes 31 to eject air onto an outer peripheral surface of the inner duct 20 formed therein. It is structured such that a channel cross-sectional area of a cooling air channel 50 that is formed between the inner duct 20 and the outer duct 30 and through which the air ejected from the ejection holes 31 flows gradually decreases at an air flow downstream side rather than the portion where the ejection holes 31 are formed, and gradually increases from a throat portion 60 having the minimized channel cross-sectional area to an air flow downstream side.

12 Claims, 6 Drawing Sheets

(56) References Cited

U.S. PATENT DOCUMENTS

| | | | | |
|---|---|---|---|---|
| 5,388,412 | A * | 2/1995 | Schulte-Werning et al. | 60/760 |
| 5,628,193 | A * | 5/1997 | Kington et al. | 60/752 |
| 6,969,230 | B2 | 11/2005 | Shi et al. | |
| 7,010,921 | B2 | 3/2006 | Intile et al. | |
| 7,340,881 | B2 * | 3/2008 | Koganezawa et al. | 60/39.511 |
| 7,493,767 | B2 | 2/2009 | Bunker et al. | |
| 7,908,867 | B2 * | 3/2011 | Keller et al. | 60/753 |
| 8,549,861 | B2 * | 10/2013 | Huffman | 60/760 |
| 2009/0249791 | A1 | 10/2009 | Belsom | |

FOREIGN PATENT DOCUMENTS

| | | | |
|---|---|---|---|
| CN | 1512036 | A | 7/2004 |
| CN | 1704573 | A | 12/2005 |
| EP | 0 207 799 | A2 | 1/1987 |
| EP | 0 239 020 | | 9/1987 |
| EP | 1 426 558 | A2 | 6/2004 |
| JP | 62-218732 | | 9/1987 |
| JP | 2000-130759 | | 5/2000 |
| JP | 2000-146186 | | 5/2000 |
| JP | 2003-286863 | | 10/2003 |
| JP | 2009-250606 | | 10/2009 |

* cited by examiner

TRANSITION PIECE BETWEEN COMBUSTOR LINER AND GAS TURBINE

CROSS-REFERENCE TO RELATED APPLICATIONS

This application is based upon and claims the benefit of priority from the prior Japanese Patent Application No. 2010-284079, filed on Dec. 21, 2010; the entire contents of which are incorporated herein by reference.

FIELD

Embodiments described herein relate generally to a transition piece and a gas turbine provided with the above transition piece.

BACKGROUND

In a gas turbine power generating plant, air compressed by driving of a compressor provided coaxially with a turbine part is led to a combustor liner. A high-temperature and high-pressure combustion gas generated by the air led to the combustor liner and fuel being mixed to be burnt is led to the turbine part through a transition piece connected to the combustor liner. In the turbine part, the high-temperature and high-pressure combustion gas is expanded to thereby rotationally drive rotor blades and a turbine rotor, and by the rotational driving, the compressor to compress air and a power generator are driven.

FIG. 6 is a view showing a cross section of a conventional transition piece 200. The conventional transition piece 200, as shown in FIG. 6, has a double-shell structure composed of an inner duct 201 and an outer duct 202 provided around an outer periphery of the inner duct 201. One end of the inner duct 201 is coupled to a combustor liner 230 in a cylindrical shape, and the other end of the inner duct 201 is coupled to a stator blade 240 at a first stage of a turbine. Thus, the shape of a cross section, of a combustion gas channel 203 in the inner duct 201, perpendicular to a flowing direction of a combustion gas changes from a circular shape to a sector of annular shape. The outer duct 202 is also formed into a shape corresponding to the shape of the inner duct 201.

The inner duct 201 has the high-temperature combustion gas flow through the inside thereof, and thus is formed of a Ni-base superalloy, and further has a cooling structure. In the outer duct 202 in the transition piece of a typical gas turbine on order of 1300° C., a plurality of impingement cooling holes 204 through which part of air discharged from the compressor is ejected and made to impinge onto/on an outer surface of the inner duct 201 as cooling air 205 are formed over the entire surface as shown in FIG. 6.

At a downstream end of the transition piece 200, there is provided a flange-shaped picture frame 206 that seals one end between the inner duct 201 and the outer duct 202 to prevent outflow of the cooling air 205 to a stator blades 240 side.

The inner duct 201 of the above-described conventional transition piece 200 is formed of a Ni-base superalloy, and is cooled by the cooling air 205. However, when a base material increases in temperature locally while the gas turbine is in operation, damage such as cracks and thickness losses due to thermal fatigue and oxidation respectively is thereby caused in the inner duct 201.

In the conventional inner duct 201, deformation has been likely to occur in the vicinity of the picture frame 206. The above deformation tends to increase with an increase in operating time of the gas turbine, so that the deformation is conceivably caused by creep damage.

An outer surface side of the inner duct 201 receives pressure from the cooling air 205, and an inner surface side of the inner duct 201 receives pressure from the combustion gas. The pressure from the cooling air 205 is higher than that from the combustion gas, so that the inner duct 201 receives a load in a direction in which the inner duct 201 is pressed from the outside. Particularly, the cross-sectional shape of the inner duct 201 connected to the turbine part is not to be a cylindrical shape, so that the inner duct 201 connected to the turbine part is more likely to be deformed against the external pressure than the inner duct 201 connected to the combustor liner 230 having the cross-sectional shape being a circular shape. The external pressure to act on the above inner duct 201 also results in a cause of making the deformation occur easily in the vicinity of the picture frame 206.

Further, at a downstream side of the inner duct 201, the flow velocity of the combustion gas increases, so that a heat transfer coefficient with the combustion gas increases, the temperature of the inner duct 201 increases, and creep deformation is likely to occur. Further, by the combustion gas being increased in temperature and pressure with an increase in capacity of the gas turbine, the temperature of the inner duct 201 further increases, and the difference in pressure between a cooling air side and a combustion gas side of the inner duct 201 tends to increase. Thus, the condition that makes the creep deformation occur easily in the inner duct 201 is made.

DETAILED DESCRIPTION

In one embodiment, a transition piece leads a combustion gas generated by burning air to which pressure is applied in a compressor and fuel in a combustor to a turbine. The above transition piece is provided with an inner duct that is connected to an outlet side end portion of the combustor liner and through which the combustion gas from the combustor liner is led to the turbine, and an outer duct that is provided so as to cover an outer periphery of the inner duct with an interval space therebetween and has a plurality of ejection holes through which part of air from the compressor is ejected onto an outer peripheral surface at an outlet side of the inner duct formed therein.

Then, it is structured such that a channel cross-sectional area of a cooling air channel that is formed between the inner duct and the outer duct and through which the air ejected from the ej ection holes flows gradually decreases at an air flow downstream side rather than the portion where the ejection holes are formed, and gradually increases from a throat portion having the minimized channel cross-sectional area to an air flow downstream side.

Hereinafter, embodiments of the present invention will be explained with reference to the drawings.

(First Embodiment)

Figure 1:
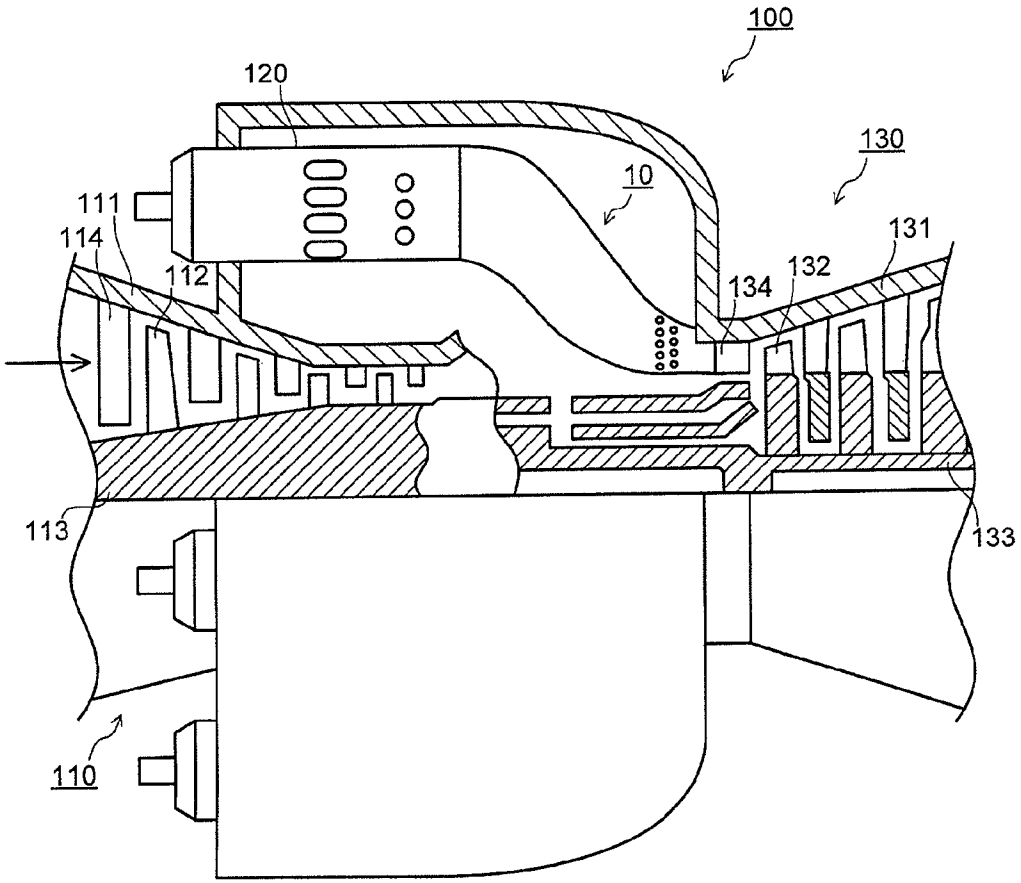
FIG. 1 is a view showing a structure of a gas turbine provided with a transition piece in a first embodiment according to the present invention, with a partial cross section.

FIG. 1 is a view showing a structure of a gas turbine 100 provided with a transition piece 10 in a first embodiment according to the present invention, with a partial cross section.

As shown in FIG. 1, the gas turbine 100 is provided with a compressor 110 in which the outside air is compressed and a combustor liner 120 in which air to which pressure is applied in the compressor 110 and fuel are mixed to be burnt. Further, the gas turbine 100 is provided with the transition piece 10 through which a combustion gas generated in the combustor liner 120 is led to a turbine part 130 and the turbine part 130 that is rotationally driven by the combustion gas introduced by the transition piece 10.

The compressor 110 is provided with, in a compressor casing 111, a compressor rotor 113 having rotor blades 112 implanted thereon. A plurality of the rotor blades 112 are implanted in a circumferential direction to form a rotor blade cascade with a plurality of stages in an axial direction. Further, a plurality of stator blades 114 are disposed on an inner periphery of the compressor casing 111 to form a stator blade cascade. Then, the stator blade cascade and the rotor blade cascade are formed alternately in the axial direction. When the rotor blades 112 rotate, the outside air is thereby compressed to be led into the gas turbine 100.

The combustor liner 120 is formed of a can-type combustor, for example, and a plurality of the combustor liners 120 are equally provided around the periphery of the compressor 110. In each of the combustor liners 120, the air to which pressure is applied in the compressor and the fuel are mixed to be burnt, and thereby the combustion gas is generated.

The transition piece 10, which will be described in detail later, is connected to an outlet side end portion of the combustor liner 120, and through the transition piece 10, the combustion gas from the combustor liner 120 is led to the turbine part 130 while the flow of combustion gas is adjusted.

The turbine part 130 is provided with, in a turbine casing 131, a turbine rotor 133 having rotor blades 132 implanted thereon. A plurality of the rotor blades 132 are implanted in the circumferential direction to form a rotor blade cascade with a plurality of stages in the axial direction. Further, on an inner periphery of the turbine casing 131, a plurality of stator blades 134 are disposed to form a stator blade cascade. Then, the stator blade cascade and the rotor blade cascade are formed alternately in the axial direction. The combustion gas introduced into the turbine part 130 is ejected onto the rotor blades 132 via the stator blades 134, and thereby the rotor blades 132 and the turbine rotor 133 rotate. Then, in a power generator (not-shown) coupled to the turbine rotor 133, rotational energy is converted into electric energy.

Next, the transition piece 10 in the first embodiment according to the present invention will be explained.

Figure 2:
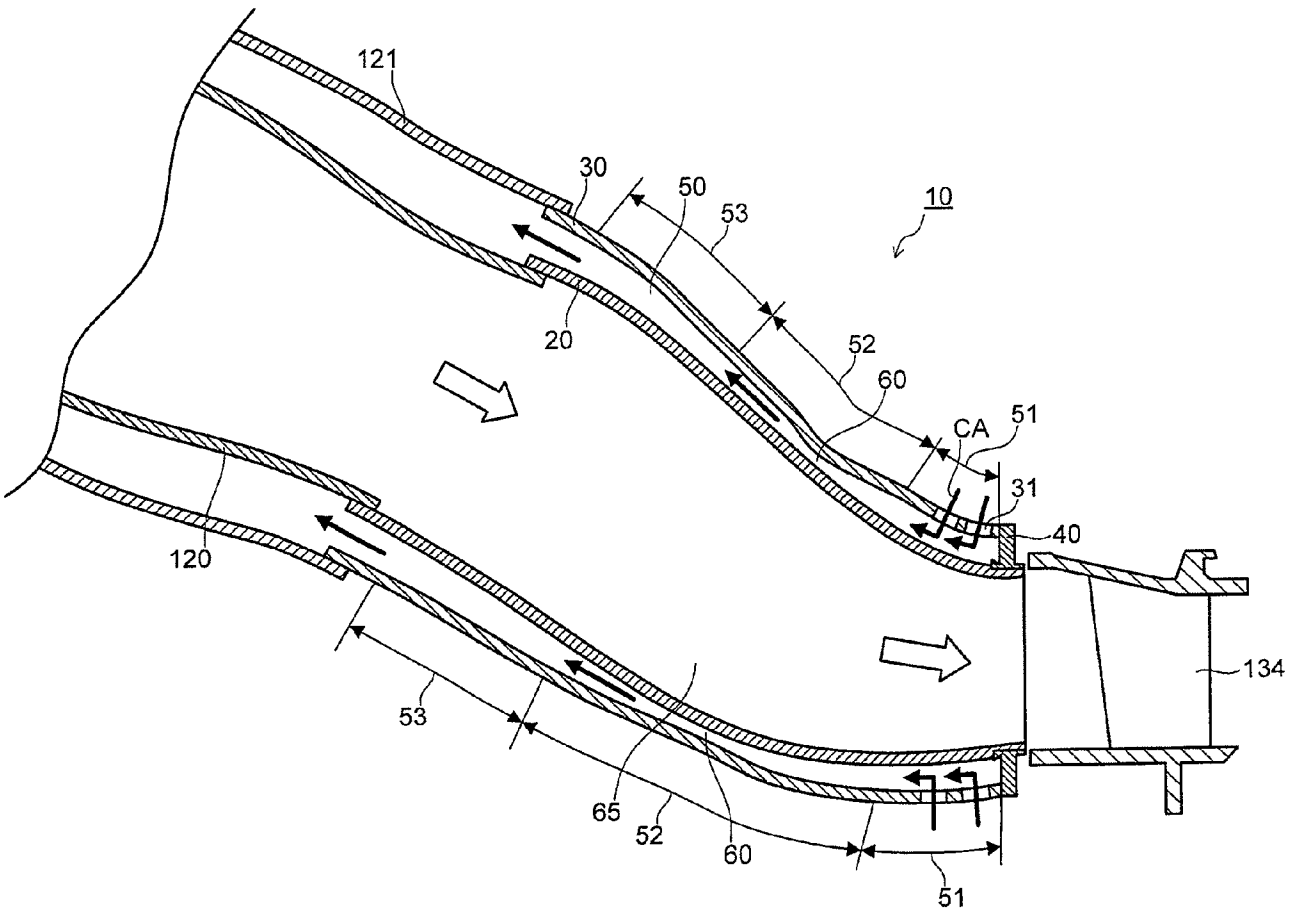
FIG. 2 is a view showing a cross section, of the transition piece in the first embodiment according to the present invention, along a flowing direction of a combustion gas.

FIG. 2 is a view showing a cross section, of the transition piece 10 in the first embodiment according to the present invention, along a flowing direction of the combustion gas.

As shown in FIG. 2, the transition piece 10 is formed into a double-shell structure provided with an inner duct 20 through which the combustion gas from the combustor liner 120 is supplied to be led to the turbine part 130 and an outer duct 30 provided so as to cover an outer periphery of the inner duct 20 with an interval space therebetween.

In the outer duct 30, a plurality of ejection holes 31 through which part of air from the compressor 110 is ejected onto an outer peripheral surface at an outlet side of the inner duct 20 are formed. The shape of each of the ejection holes 31 is preferably a circular shape having the smallest hydraulic diameter in order to suppress a pressure loss. Further, the diameter of each of the ejection holes 31 is preferably as large as possible. Note that part of the air from the compressor 110, which is described above, functions as cooling air CA.

An upstream side end portion of the inner duct 20 (a left end portion of the inner duct 20 in FIG. 2) is opened into a circular shape. Into the opened end portion, an outlet side end portion of the cylindrical combustor liner 120 (a right end portion of the combustor liner 120 in FIG. 2) fits. On the other hand, a downstream side end portion of the inner duct 20 (a right end portion of the inner duct 20 in FIG. 2) is opened into a rectangular shape or a sector of annular shape. In this manner, the shape of the cross section, of the inner duct 20, perpendicular to the flowing direction of the combustion gas changes from a circular shape to a sector of annular shape.

The outer duct 30 also has a shape corresponding to the shape of the inner duct 20, and an upstream side end portion of the outer duct 30 (a left end portion of the outer duct 30 in FIG. 2) is opened into a circular shape, and a downstream side end portion of the outer duct 30 (a right end portion of the outer duct 30 in FIG. 2) is opened into a rectangular shape or a sector of annular shape. Further, the upstream side end portion of the outer duct 30 (the left end portion of the outer duct 30 in FIG. 2) fits into an outlet side end portion of a cylindrical combustor outer cylinder 121 (a right end portion of the combustor outer cylinder 121 in FIG. 2) that is provided so as to cover an outer periphery of the combustor liner 120 with an interval space therebetween.

At a downstream side end portion between the inner duct 20 and the outer duct 30 of the transition piece 10 (a right end portion between the inner duct 20 and the outer duct 30 in FIG. 2), there is provided a flange-shaped picture frame 40 that seals one end between the inner duct 20 and the outer duct 30 to prevent outflow of the cooling air CA to a turbine part 130 side. In the outer duct 30 in the vicinity of the above picture frame 40, a plurality of the above-described ejection holes 31 are formed.

Next, there will be explained a cooling air channel 50 that is formed between the inner duct 20 and the outer duct 30 and through which the cooling air CA flows.

A channel cross-sectional area of the cooling air channel 50 gradually decreases at a cooling air flow downstream side rather than a cooling air inlet zone 51 where the ejection holes 31 are formed. Then, the cooling air channel 50 has a throat portion 60 having the minimized channel cross-sectional area. The channel cross-sectional area of the cooling air channel 50 gradually increases from the above throat portion 60 to an air flow downstream side.

Note that the channel cross-sectional area of the cooling air channel 50 is an area of the channel cross section perpendicular to a flowing direction of the cooling air CA. Further, a region from the channel cross-section at a cooling air flow downstream side rather than the cooling air inlet zone 51 to the channel cross-section which the channel cross-sectional area of the cooling air channel 50 is equalized to that of the cooling air channel 50 in the cooling air inlet zone 51, is set to a cooling air high-velocity zone 52. A region at a cooling air flow downstream side rather than the above cooling air high-velocity zone 52 is set to a pressure recovery zone 53.

Here, the total area obtained by adding areas of the above-described respective ejection holes 31 is preferably larger than the channel cross-sectional area of the cooling air channel at the throat portion 60, and the passing velocity of the cooling air is required to be decreased in order to suppress a pressure loss of the cooling air as much as possible. Further, in order to obtain an effect of cooling equal to conventional impingement cooling, the channel cross-sectional area at the throat portion 60 is preferably set such that the flow velocity of the cooling air CA at the throat portion 60 becomes 70 m/s or more.

Incidentally, in terms of maintaining an effect of adjusting the flow of combustion gas flowing through the inner duct 20, the cooling air channel 50 in such a structure is preferably formed in a manner that the shape of the outer duct 30 is changed without changing the shape of the inner duct 20. Thus, by getting (approximating) the outer duct 30 close to an inner duct 20 side (an inner side), the interval (the distance) between the outer duct 30 and the inner duct 20 is shortened to decrease the channel cross-sectional area.

A plurality of the transition pieces 10 each having the structure as above are equally provided around the periphery of the compressor 110 as described above. Thus, outlet sides of the transition pieces 10 that are rectangular shaped or sector shaped and adjacent to each other come into contact with each other, and thereby an annular combustion gas channel is formed as a whole.

Next, functions of the combustion gas flowing through the inner duct 20 and the cooling air CA flowing through the cooling air channel 50 will be explained.

The diameter of each of the ejection holes 31 is preferably made as large as possible as describe above. Thus, the flow velocity of the cooling air CA passing through the ejection holes 31 becomes smaller than the ejection velocity in conventional impingement cooling holes. However, the diameter of each of the ejection holes 31 is larger than that of each of the conventional impingement cooling holes. Further, pitches each between the ejection holes 31 are decreased to form the ejection holes 31 closely, and thereby a flow amount of the cooling air CA passing through the ejection holes 31 can be increased. Thus, in the cooling air inlet zone 51, the effect of impingement cooling is exhibited, and the sufficient cooling effect is obtained.

In the cooling air high-velocity zone 52, due to a decrease in channel cross-sectional area of the inner duct 20, the flow velocity of the combustion gas flowing through the inner duct 20 increases. Thus, a heat transfer coefficient between the inner duct 20 and the combustion gas increases, and thereby the temperature of the inner duct 20 is likely to increase. However, the channel cross-sectional area of the cooling air channel 50 in the cooling air high-velocity zone 52 is smaller than that of the cooling air channel 50 in the cooling air inlet zone 51 or the like, so that the velocity of the cooling air CA increases. Thus, a heat transfer coefficient between the inner duct 20 and the cooling air CA increases, and thereby the inner duct 20 can be cooled sufficiently.

Further, in the cooling air high-velocity zone 52, when the velocity of the cooling air CA increases, a dynamic pressure of fluid thereby increases, but its static pressure decreases. Thus, a load that is applied to the inner duct 20 from a cooling air channel 50 side to a combustion gas channel 65 side decreases. In other words, the differential pressure between pressure of the cooling air channel 50 side and pressure of the combustion gas channel 65 side via the inner duct 20 can be decreased.

In the pressure recovery zone 53, the velocity of the cooling air CA gradually decreases, and thereby the dynamic pressure of the cooling air CA decreases and its static pressure increases. In the above pressure recovery zone 53, the flow velocity of the combustion gas flowing through the inner duct 20 is small as compared to that in the cooling air high-velocity zone 52, and the heat transfer coefficient between the inner duct 20 and the combustion gas is also small as compared to that in the cooling air high-velocity zone 52. Thus, even though the velocity of the cooling air CA decreases, the inner duct 20 can be sufficiently cooled.

The cooling air CA that has passed through the cooling air channel 50 in the pressure recovery zone 53 flows into a cooling air channel formed between the combustor liner 120 and the combustor outer cylinder 121. On this occasion, in the pressure recovery zone 53, the velocity of the cooling air CA is decreased to decrease the dynamic pressure of the cooling air CA. Thus, a dynamic pressure loss caused when the cooling air CA flows into the cooling air channel formed between the combustor liner 120 and the combustor outer cylinder 121 can be suppressed.

Figure 3:
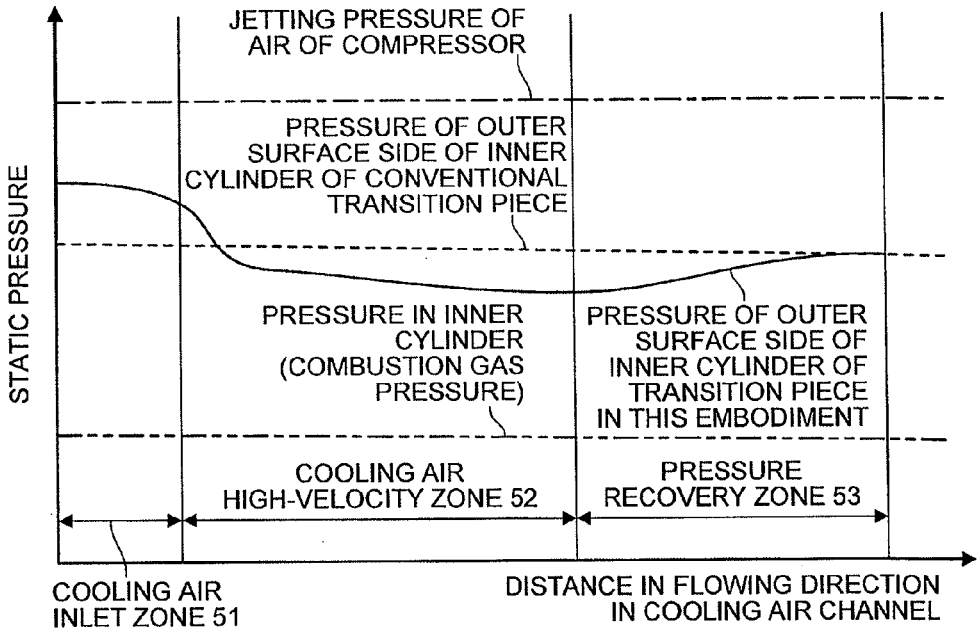
FIG. 3 is a view showing a change in static pressure, of a cooling air channel, in a flowing direction of cooling air in the transition piece in the first embodiment.
Figure 6:
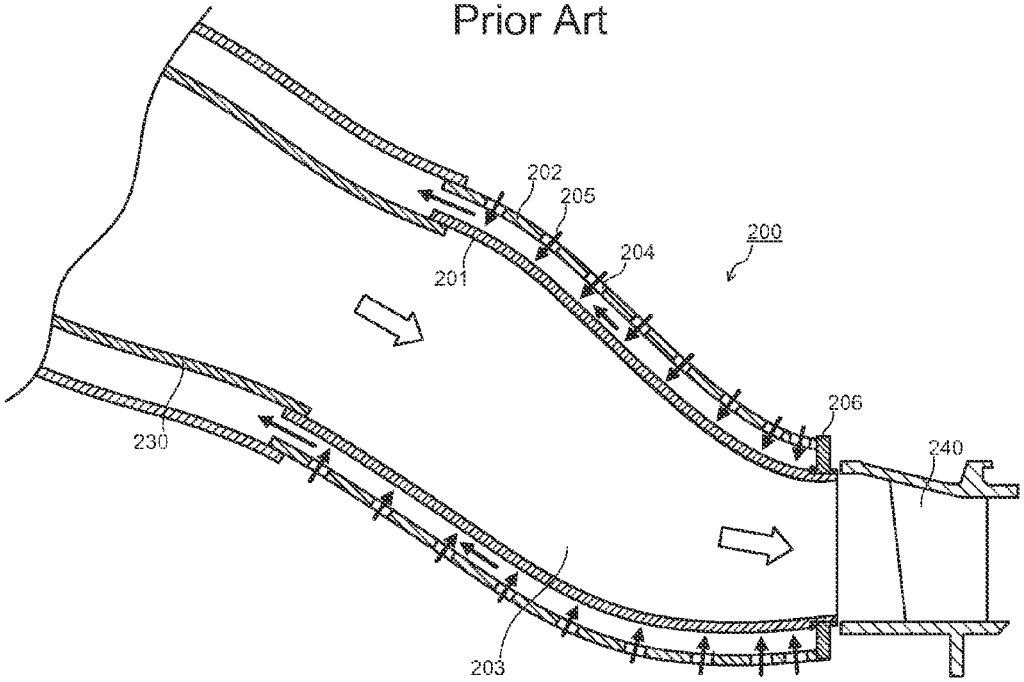
FIG. 6 Prior Art
FIG. 6 is a view showing a cross section of a conventional transition piece.

Here, FIG. 3 is a view showing a change in static pressure, of the cooling air channel 50, in the flowing direction of the cooling air CA in the transition piece 10 in the first embodiment. Note that for comparison, a change in static pressure, of a cooling air channel, in a flowing direction of cooling air in a conventional transition piece 200 shown in FIG. 6 is also shown in FIG. 3.

As shown in FIG. 3, in the cooling air high-velocity zone 52, the differential pressure between the pressure of the cooling air channel side and the pressure of the combustion gas channel side via the inner duct can be decreased in the transition piece 10 in this embodiment rather than in the conventional transition piece 200.

According to the transition piece 10 in the first embodiment, by the cooling air high-velocity zone 52 in which the flow velocity of the cooling air CA is increased being provided in the cooling air channel 50, the heat transfer coefficient between the inner duct 20 and the cooling air CA increases, and the inner duct 20 can be cooled sufficiently.

Further, the differential pressure between the pressure of the cooling air channel 50 side and the pressure of the combustion gas channel 65 side via the inner duct 20 can be decreased. Thus, a load to act in a direction to press the inner duct 20 from the outside can be decreased, and deformation of the inner duct 20 can be suppressed.

(Second Embodiment)

The structure of a transition piece 11 in a second embodiment except that channel guides 70 are provided in a cooling air channel 50 is the same as that of the transition piece 10 in the first embodiment. Here, the different structure will be explained mainly.

Figure 4:
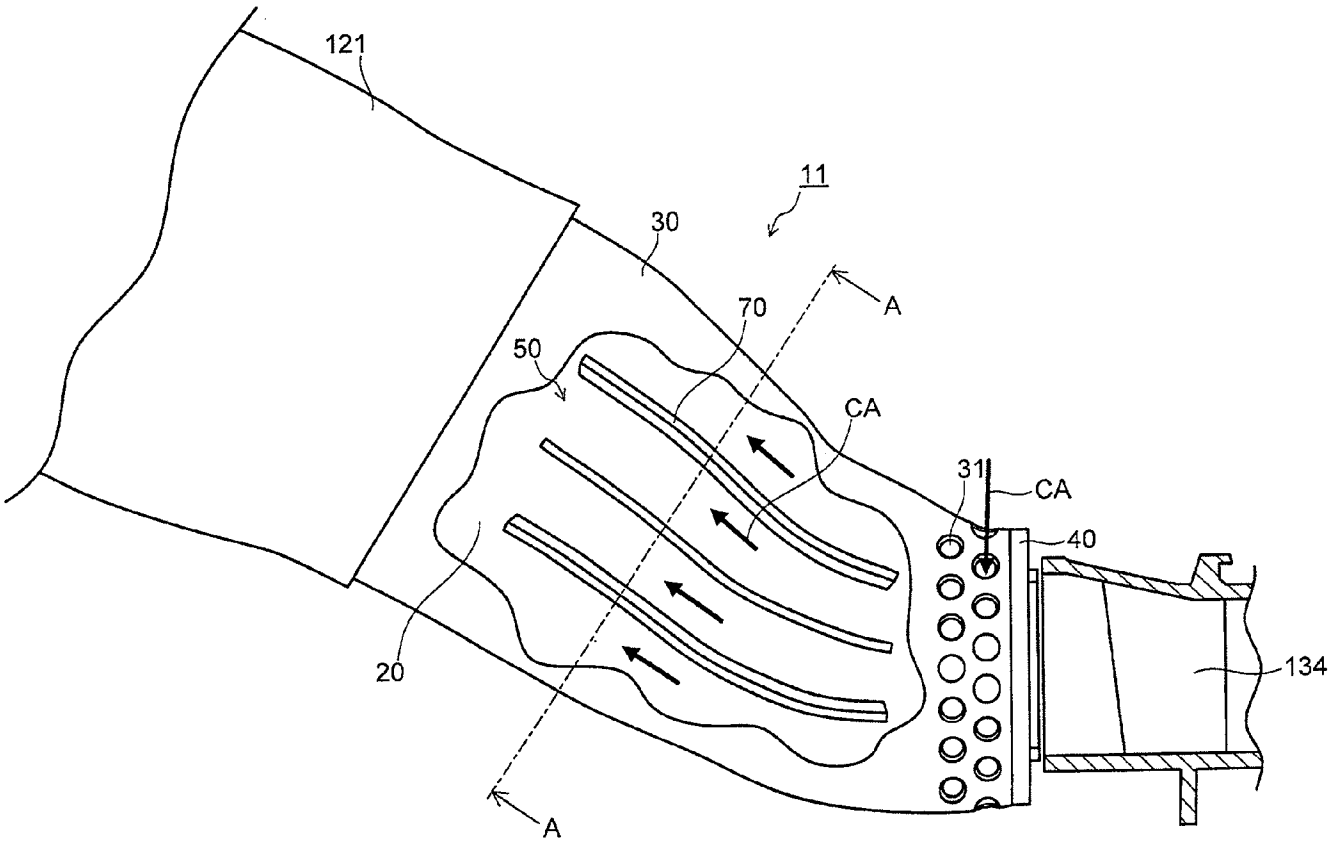
FIG. 4 is a side view of a transition piece in a second embodiment according to the present invention, which is shown in a state where part of an outer duct of the transition piece is removed in order to explain channel guides.
Figure 5:
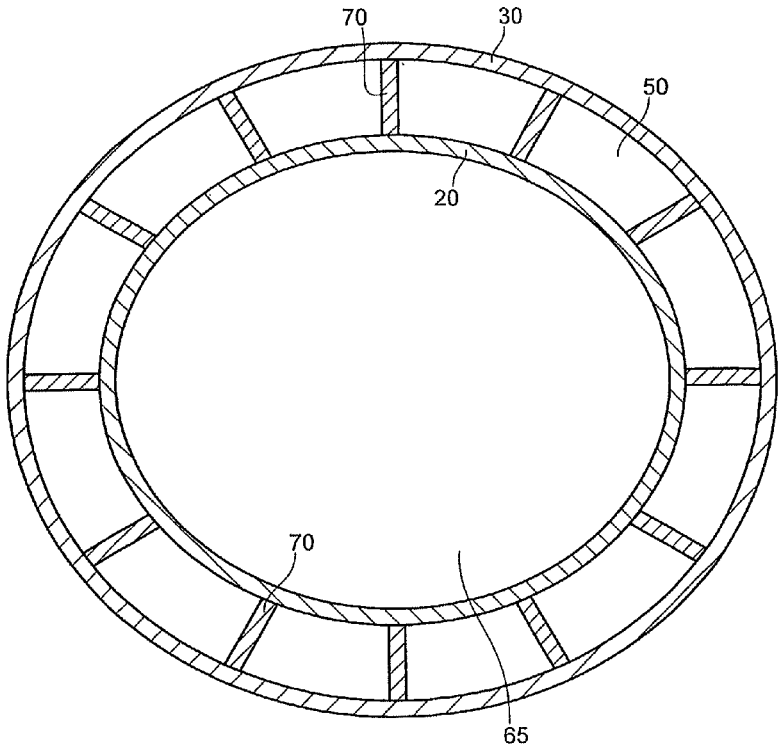
FIG. 5 is a view showing a cross section taken along A-A line in FIG. 4 where the transition piece in the second embodiment according to the present invention is shown.

FIG. 4 is a side view of the transition piece 11 in the second embodiment according to the present invention, which is shown in a state where part of an outer duct 30 of the transition piece is removed in order to explain the channel guides 70. Note that in FIG. 4, the vicinity of stator blades 134 is shown in a cross-sectional view for convenience. FIG. 5 is a view showing a cross section taken along A-A line in FIG. 4 where the transition piece 11 in the second embodiment according to the present invention is shown. Incidentally, parts that are the same as those of the structure of the transition piece 10 in the first embodiment are denoted by the same reference numerals, and overlapped explanation thereof will be omitted or simplified.

As shown in FIG. 4, in the cooling air channel 50, a plurality of the channel guides 70 provided in a flowing direction of cooling air CA are provided in a circumferential direction at predetermined intervals. Further, the channel guides 70 are disposed so as to divide the cooling air channel 50 into a plurality of sections in the circumferential direction. The channel guides 70 are preferably provided at least in a cooling air high-velocity zone 52.

The channel guides 70 are each formed of a plate member, and are each formed into a shape corresponding to the shape of the cooling air channel 50 in the flowing direction of the cooling air CA. The channel guides 70 are preferably provided so as to come into contact with an outer surface of an inner duct 20 and an inner surface of the outer duct 30. For example, it is possible to integrally form the channel guides 70 on the outer surface of the inner duct 20 or the inner surface of the outer duct 30.

The cross-sectional shape of the transition piece 11 three-dimensionally changes from a circular shape at an upstream side end portion (a left end portion in FIG. 4) to a rectangular shape or a sector of annular shape at a downstream side end portion (a right end portion in FIG. 4). Thus, the channel cross-sectional shape of the cooling air channel 50 also three-dimensionally changes similarly. Thus, the cooling air CA that flows through the cooling air channel 50 deflects toward the circumferential direction and thus does not flow uniformly on the channel cross section.

Thus, as is the transition piece 11 in the second embodiment, by the channel guides 70 being provided in the cooling air channel 50, the deflection of the flow toward the circumferential direction is suppressed and thereby the uniformized flow of the cooling air CA on the channel cross section can be achieved. This makes it possible to uniformly cool the inner duct 20 over the circumferential direction.

According to the above-explained embodiments, it is possible to suppress deformation of a component member, and it becomes possible to improve the cooling effect by the cooling air.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A transition piece configured to lead a combustion gas to a turbine, the combustion gas being generated by burning air pressurized by a compressor and fuel in a combustor liner, the transition piece comprising:

an inner duct connected to an end portion of an outlet of the combustor liner, the inner duct being configured to lead the combustion gas from the combustor liner to the turbine;

an outer duct surrounding an outer periphery of the inner duct with an interval space therebetween to form a cooling air channel surrounding the inner duct, the outer duct having a plurality of ejection holes configured to eject a part of air from the compressor into the outer periphery at an outlet side of the inner duct formed therein; and a throat portion configured to flow air ejected from the ejection holes, the throat portion being formed circumferentially on the cooling air channel formed between the inner duct and the outer duct at a position having a minimum channel cross-sectional area of the cooling air channel, the throat portion being formed by changing a shape of a diameter of the outer duct at the position having the minimum channel cross-sectional area of the cooling air channel, wherein a channel cross-sectional area of the cooling air channel gradually decreases at an air flow downstream side rather than a portion where the ejection holes are formed, and the channel cross-sectional area gradually increases from the throat portion to the air flow downstream side.

2. The transition piece according to claim 1, wherein a total area obtained by adding areas of the respective ejection holes is larger than the channel cross-sectional area of the cooling air channel at the throat portion.

3. The transition piece according to claim 1, further comprising a plurality of channel guides provided in an air flowing direction on at least one region of the cooling air channel in a circumferential direction.

4. The transition piece according to claim 2, further comprising a plurality of channel guides provided in an air flowing direction on at least one region of the cooling air channel in a circumferential direction.

5. The transition piece according to claim 3, wherein the channel guides are integrally formed on the inner duct or the outer duct.

6. The transition piece according to claim 4, wherein the channel guides are integrally formed on the inner duct or the outer duct.

7. A gas turbine provided with the transition piece according to claim 1.

8. A gas turbine provided with the transition piece according to claim 2.

9. A gas turbine provided with the transition piece according to claim 3.

10. A gas turbine provided with the transition piece according to claim 4.

11. A gas turbine provided with the transition piece according to claim 5.

12. A gas turbine provided with the transition piece according to claim 6.

* * * * *